US007938680B1

(12) United States Patent
Hsieh

(10) Patent No.: US 7,938,680 B1
(45) Date of Patent: May 10, 2011

(54) GROUNDING ELECTRICAL CONNECTOR

(75) Inventor: Chi-Feng Hsieh, Taipei (TW)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 12/759,084

(22) Filed: Apr. 13, 2010

(51) Int. Cl.
*H01R 9/05* (2006.01)

(52) U.S. Cl. ..... 439/578

(58) Field of Classification Search ..... 439/578, 439/352

See application file for complete search history.

(56) References Cited

U.S. PATENT DOCUMENTS

| | | | | |
|---|---|---|---|---|
| 3,206,540 | A * | 9/1965 | Cohen | 174/89 |
| 4,412,717 | A * | 11/1983 | Monroe | 439/582 |
| 4,426,127 | A * | 1/1984 | Kubota | 439/607.17 |
| 5,316,494 | A * | 5/1994 | Flanagan et al. | 439/352 |
| 6,709,289 | B2 * | 3/2004 | Huber et al. | 439/578 |
| 6,811,422 | B1 * | 11/2004 | Muller | 439/314 |
| 7,189,097 | B2 * | 3/2007 | Benham | 439/352 |
| 7,291,033 | B2 * | 11/2007 | Hu | 439/347 |
| 7,318,609 | B2 * | 1/2008 | Naito et al. | 285/322 |
| 7,329,139 | B2 * | 2/2008 | Benham | 439/352 |
| 7,351,088 | B1 * | 4/2008 | Qu | 439/352 |
| 7,568,945 | B2 * | 8/2009 | Chee et al. | 439/578 |
| 7,682,206 | B2 * | 3/2010 | Kainz | 439/824 |
| 7,722,379 | B2 * | 5/2010 | Yang et al. | 439/352 |
| 7,758,370 | B1 * | 7/2010 | Flaherty | 439/352 |
| 2003/0027435 | A1 * | 2/2003 | Schneider et al. | 439/63 |
| 2003/0139081 | A1 * | 7/2003 | Hall et al. | 439/352 |
| 2007/0087613 | A1 * | 4/2007 | Schumacher et al. | 439/352 |
| 2007/0173100 | A1 * | 7/2007 | Benham | 439/352 |
| 2008/0214040 | A1 * | 9/2008 | Holterhoff et al. | 439/352 |
| 2010/0099300 | A1 * | 4/2010 | Hsieh | 439/607.41 |

* cited by examiner

*Primary Examiner* — T C Patel
*Assistant Examiner* — Vladimir Imas
(74) *Attorney, Agent, or Firm* — Rosenberg, Klein & Lee

(57) ABSTRACT

A grounding electrical connector includes: an inner sleeve, a front end of the inner sleeve having an outer flange, an annular groove being formed on an inner circumference of the outer flange; an outer sleeve coaxially positioned around the inner sleeve; a nut formed with an inner threaded section for locking with a threaded interface connector of an electronic device, the nut further having a receptacle for receiving the outer flange of the inner sleeve therein; and a conductive grounding spring mounted in the annular groove of the inner sleeve and having multiple inner resilient concave sections. When the threaded section of the nut is screwed onto the threaded interface connector of the electronic device, the inner resilient concave sections of the conductive grounding spring are mechanically and electrically connected with a circumference of the threaded interface connector.

3 Claims, 6 Drawing Sheets

GROUNDING ELECTRICAL CONNECTOR

BACKGROUND OF THE INVENTION

1. Field of the Invention

The present invention relates generally to a connector, and more particularly to a grounding electrical connector with a good grounding effect.

2. Description of the Related Art

It is well known that a coaxial cable connector is connectable with a threaded interface connector of an electronic device to electrically connect a coaxial cable with the electronic device.

The conventional coaxial cable connector has some defects. For example, the main body of the coaxial cable connector must be connected with the interface connector with a good grounding connection. This is involved in whether the coaxial cable connector is well grounded. FIG. 1 shows an F-type connector as atypical example of the conventional connector. The F-type connector includes a connector main body 10. The connector main body 10 includes an outer sleeve 11, an inner sleeve 12 coaxially positioned in the outer sleeve 11 and a nut 13 rotatably fitted around the inner sleeve 12. The connector main body 10 serves to mechanically and electrically connect a coaxial cable with a threaded interface connector 15 of an electronic device 14.

There is an inherent problem existing in the connection between the F-type connector main body 10 and the threaded interface connector 15. That is, the nut 13 cannot be fully connected with the threaded interface connector 15 and a gap S is left between the inner sleeve 12 and the threaded interface connector 15. The gap S leads to poor contact between the connector main body 10 and the threaded interface connector 15 and poor grounding thereof. As a result, the electrical signal transmission performance is deteriorated.

It is therefore tried by the applicant to provide a grounding electrical connector, which can be effectively and lastingly connected with the threaded interface connector with a good grounding connection so as to achieve a good electrical performance.

SUMMARY OF THE INVENTION

A primary object of the present invention is to provide a grounding electrical connector includes a conductive grounding spring mounted in an inner sleeve. An inner threaded section of a nut of the grounding electrical connector is locked with a threaded interface connector of an electronic device to achieve a secure grounding connection so as to ensure good signal transmission quality and good electrical performance.

To achieve the above and other objects, the grounding electrical connector of the present invention includes: an inner sleeve, a front end of the inner sleeve having an outer flange, an annular groove being formed on an inner circumference of the outer flange; an outer sleeve coaxially positioned around the inner sleeve; a nut formed with an inner threaded section for locking with a threaded interface connector of an electronic device, the nut further having a receptacle for receiving the outer flange of the inner sleeve therein; and a conductive grounding spring mounted in the annular groove of the inner sleeve and having multiple inner resilient concave sections. When the threaded section of the nut is screwed onto the threaded interface connector of the electronic device, the inner resilient concave sections of the conductive grounding spring are mechanically and electrically connected with a circumference of the threaded interface connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
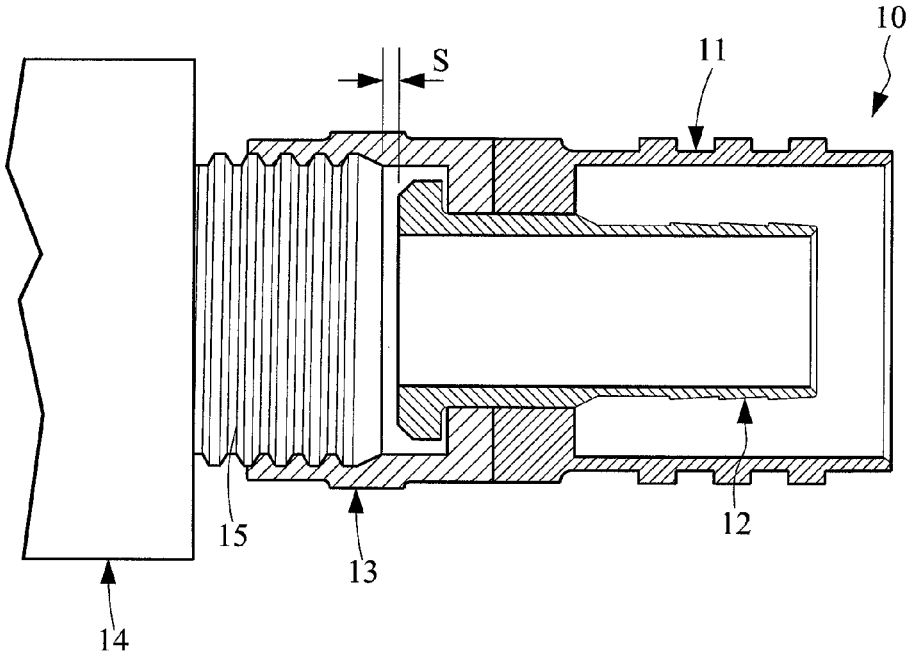
FIG.1 PRIOR ART
FIG. 1 is a sectional view showing that a conventional coaxial cable connector is not fully connected with a threaded interface connector of an electronic device.
Figure 2:
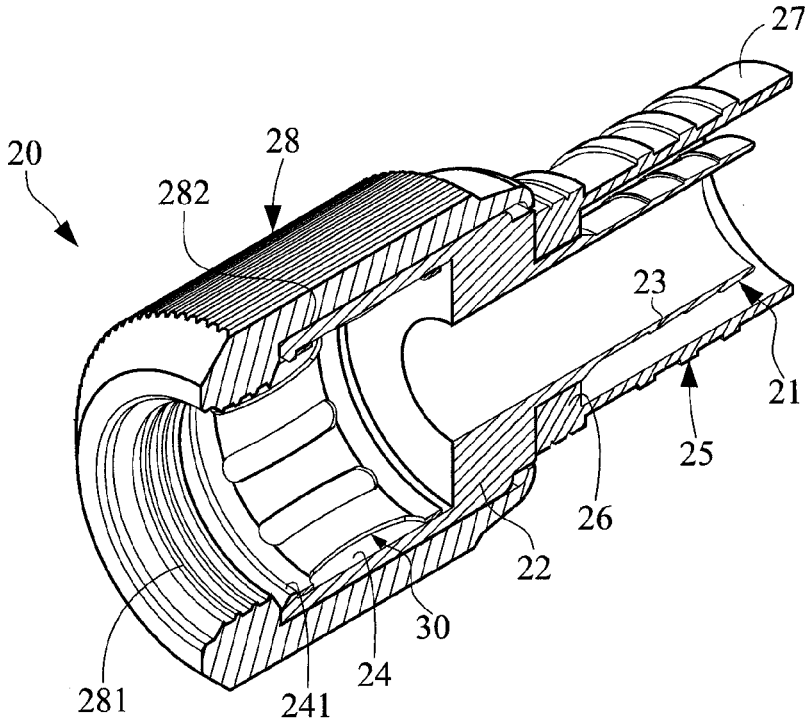
FIG. 2 is a perspective sectional view of the grounding electrical connector of the present invention.
Figure 3:
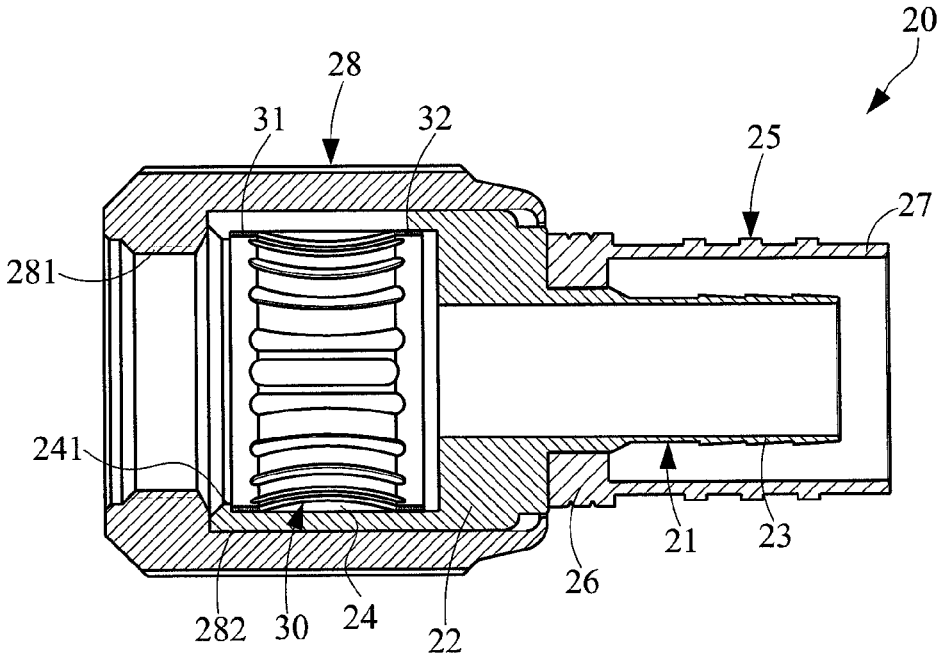
FIG. 3 is a sectional view of the grounding electrical connector of the present invention.

Please refer to FIGS. 2 and 3, in which FIG. 2 is a perspective sectional view of the grounding electrical connector of the present invention and FIG. 3 is a sectional view of the grounding electrical connector of the present invention. The grounding electrical connector 20 includes an inner sleeve 21, an outer sleeve 25 and a conductive grounding spring 30. A front end of the inner sleeve 21 has an outer flange 22. A rear end of the inner sleeve 21 has a rearward extending section 23. The rearward extending section 23 has an outer diameter and a wall thickness smaller than those of the outer flange 22. An annular groove 24 is formed on an inner circumference of the outer flange 22 for receiving the conductive grounding spring 30 therein. A front end of the annular groove 24 has an annular stop section 241 for locating the conductive grounding spring 30 in the annular groove 24. A front end of the outer sleeve 25 has an inner flange 26 embracing the inner sleeve 21. A rear end of the outer sleeve 25 has a rearward extending section 27. The rearward extending section 27 has an outer diameter and a wall thickness smaller than those of the inner flange 26. The rearward extending section 27 of the outer sleeve 25 coaxially surrounds the rearward extending section 23 of the inner sleeve 21 to define an annular space between the rearward extending section 27 of the outer sleeve 25 and the rearward extending section 23 of the inner sleeve 21. A nut 28 is disposed at a front end of the grounding electrical connector 20. A rear end of the nut 28 is freely rotatably connected with the outer flange 22 of the inner sleeve 21 by means of rolling. The nut 28 is formed with an inner threaded section 281 for locking with a threaded interface connector of an electronic device. The nut 28 further has a receptacle 282 for receiving the outer flange 22 of the inner sleeve 21 therein. In practice, the nut 28 is applicable to F-type connector, TNC-type connector, SMA-type connector, N-type connector, etc.

Figure 4:
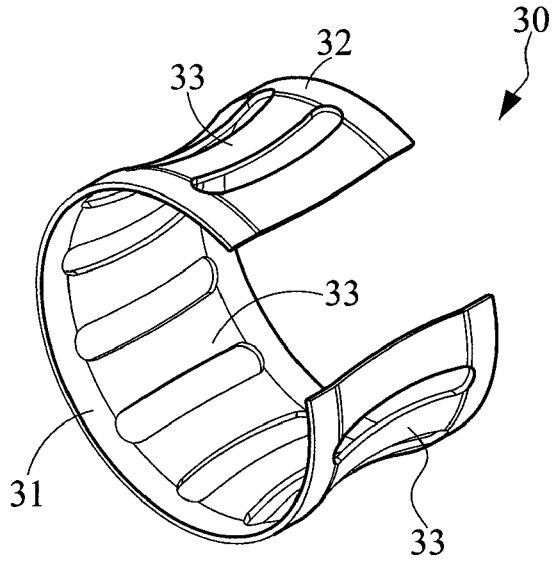
FIG. 4 is a perspective view of the conductive grounding spring of the grounding electrical connector of the present invention.
Figure 5:
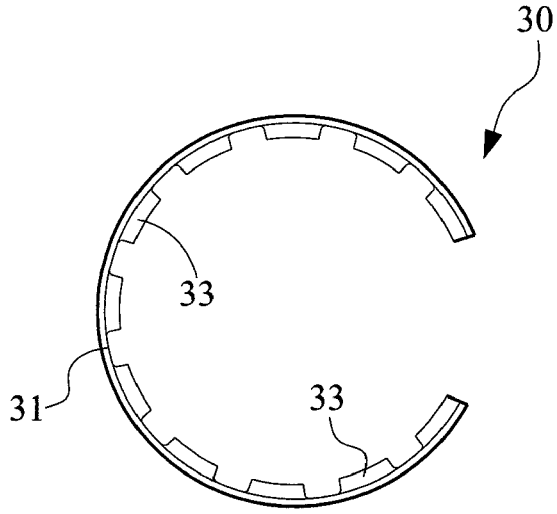
FIG. 5 is a left view of the conductive grounding spring of the grounding electrical connector of the present invention.

Referring to FIGS. 4 and 5, the conductive grounding spring 30 includes a front and a rear annular end sections 31, 32 in contact with an inner face of the annular groove 24, and multiple slat-like inner resilient concave sections 33 integrally interconnected between the front and rear annular end sections 31, 32 at equal intervals. The conductive grounding spring 30 has a length shorter than that of the annular groove 24.

Figure 6:
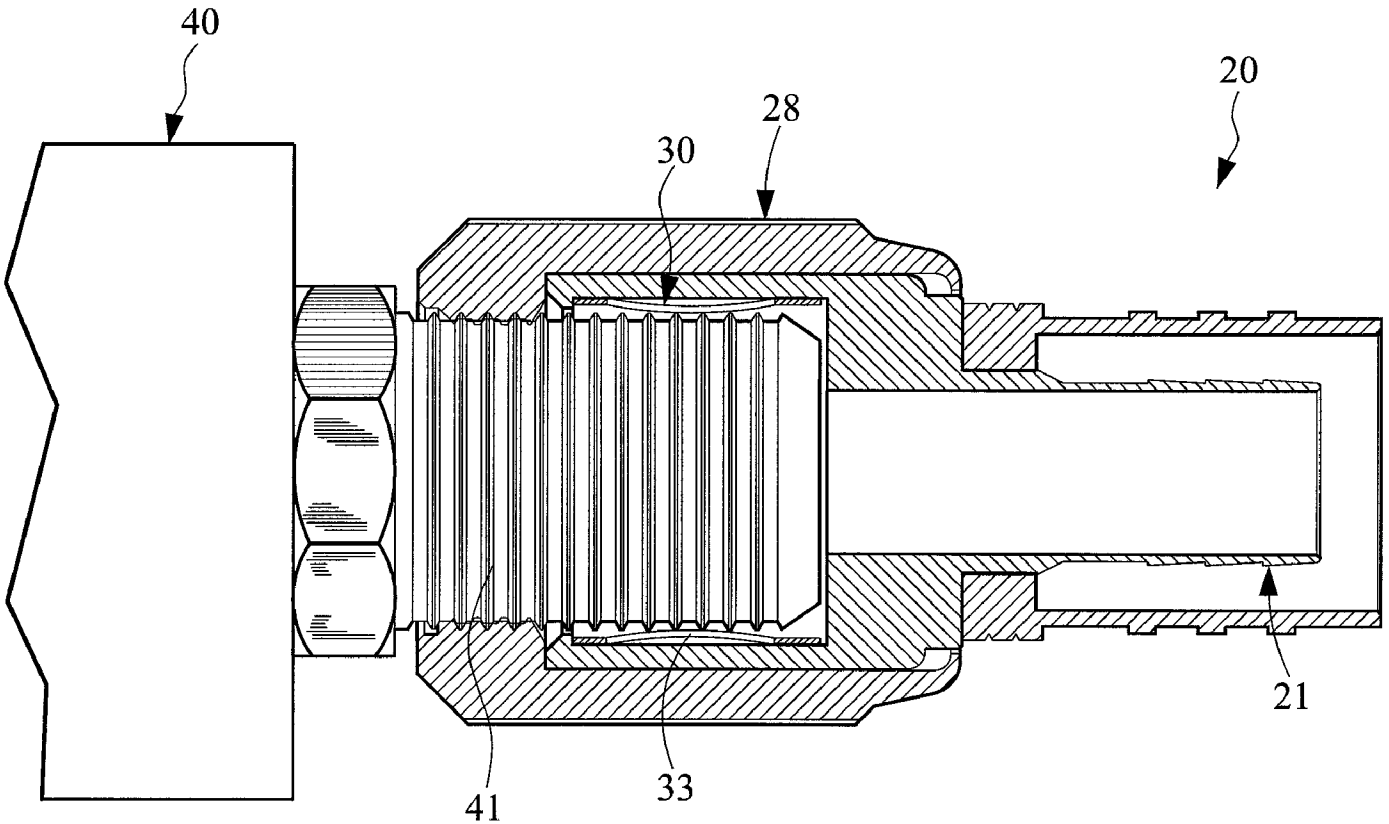
FIG. 6 is a sectional view showing that the grounding electrical connector of the present invention is connected with a threaded interface connector of an electronic device.

The resilient concave sections 33 are mechanically and electrically connected with a threaded interface connector 41 of an electronic device 40 (as shown in FIG. 6).

Referring to FIG. 6, when the nut 28 of the grounding electrical connector 20 is screwed onto the threaded interface connector 41 of an electronic device 40, the resilient concave sections 33 of the conductive grounding spring 30 are radially compressed by the threaded interface connector 41. Accordingly, the resilient concave sections 33 are securely affixed to the threaded interface connector 41. In this case, it is ensured that the inner sleeve 21 is effectively and lastingly mechanically and electrically connected with the threaded interface connector 41 with a good grounding connection. Under such circumstance, a good signal transmission quality and a good electrical performance can be ensured.

Figure 7:
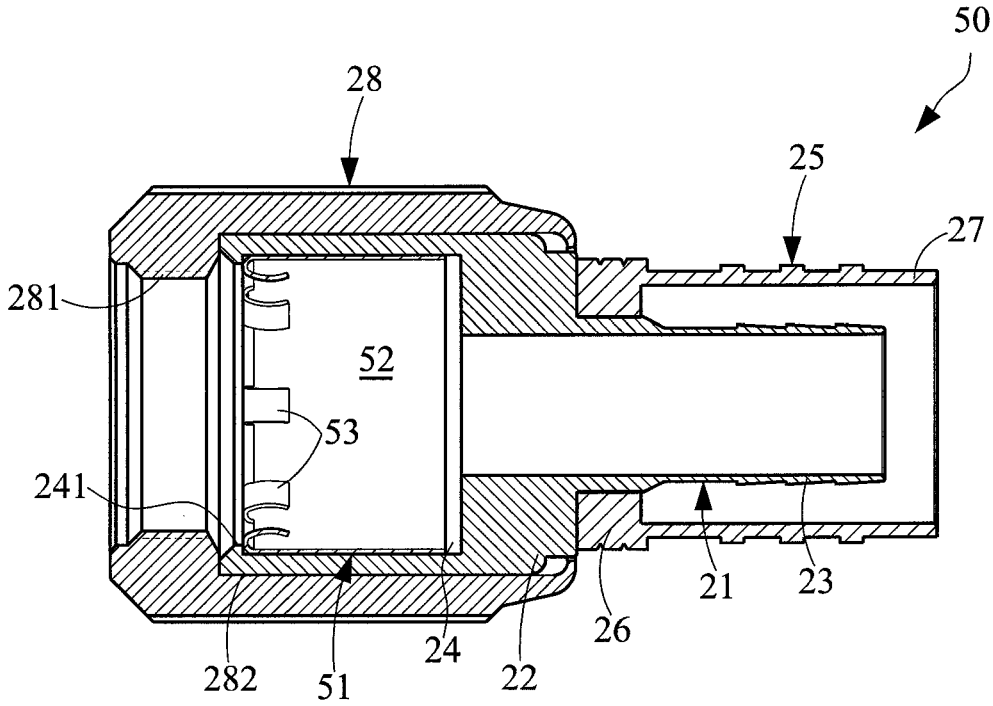
FIG. 7 is a sectional view of another embodiment of the grounding electrical connector of the present invention.
Figure 8:
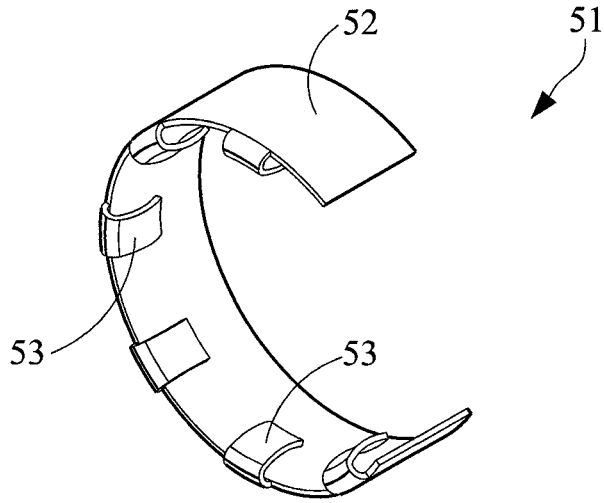
FIG. 8 is a perspective view of the conductive grounding spring according to FIG. 7.

FIGS. 7 and 8 show a second embodiment of the grounding electrical connector 50 of the present invention, in which the components identical to those of the first embodiment of FIGS. 2 and 3 are denoted with the same reference numerals. The second embodiment is different from the first embodiment in the configuration of the conductive grounding spring 51. In the second embodiment, the conductive grounding spring 51 includes an annular main body 52 in contact with the inner face of the annular groove 24 of the inner sleeve 21, and multiple slat-like inner resilient concave sections 53 integrally connected with an end of the annular main body 52 at equal intervals.

Figure 9:
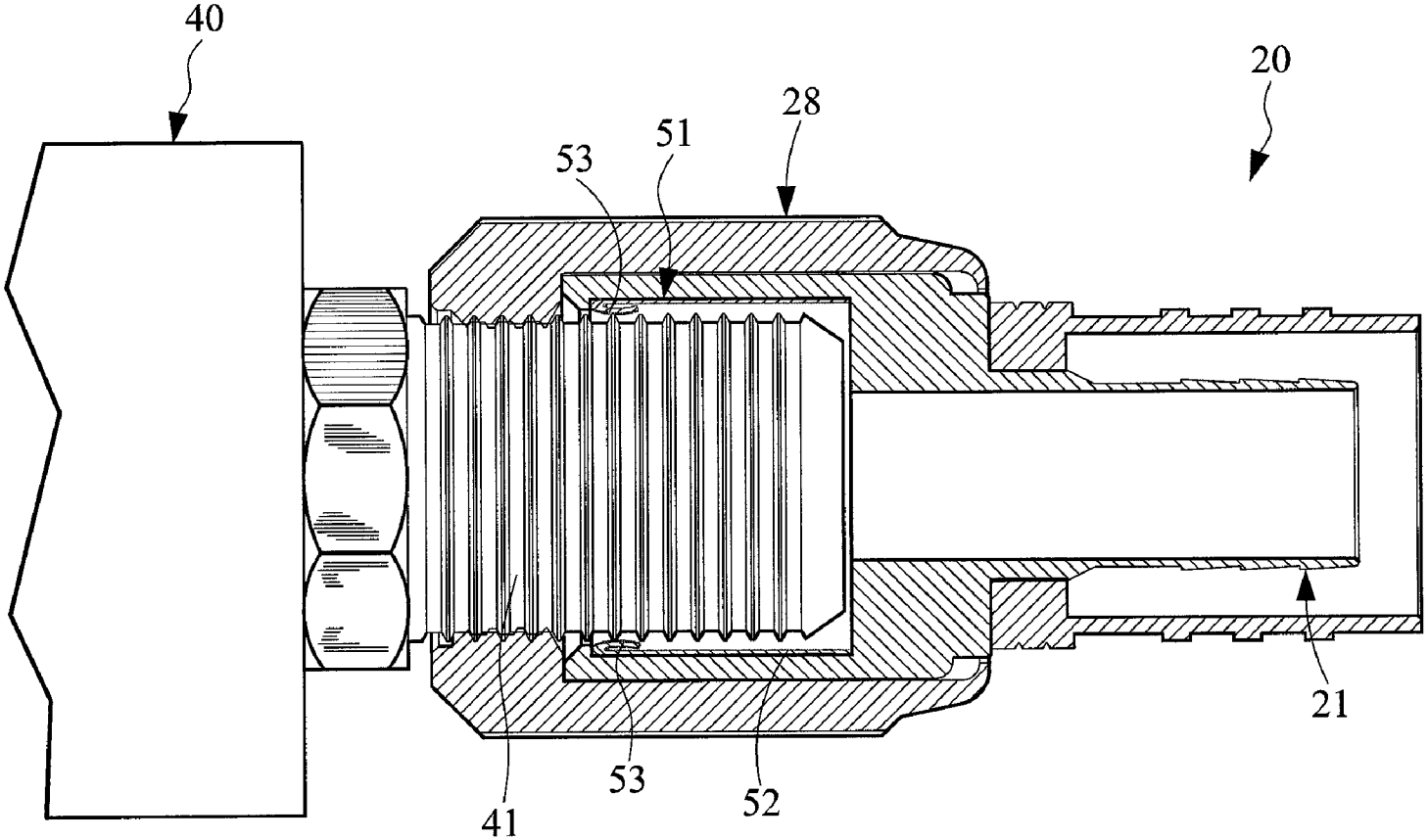
FIG. 9 is a sectional view showing that the grounding electrical connector of the present invention according to FIG. 7 is connected with a threaded interface connector of an electronic device.

The resilient concave sections 53 extend from the end of the annular main body 52 and are bent into the annular main body 52 in a curved form. The resilient concave sections 53 are radially compressed by the threaded interface connector 41 and securely affixed thereto (as shown in FIG. 9).

The above embodiments are only used to illustrate the present invention, not intended to limit the scope thereof. It is understood that many changes or modifications of the above embodiments can be made by those who are skilled in this field without departing from the spirit of the present invention. The scope of the present invention is limited only by the appended claims.

The invention claimed is:

1. A grounding electrical connector for mechanically and electrically connecting a coaxial cable with a threaded interface connector of an electronic device, the grounding electrical connector comprising:

an inner sleeve, a front end of the inner sleeve having an outer flange, an annular groove being formed on an inner circumference of the outer flange;

an outer sleeve coaxially positioned around the inner sleeve;

a nut formed with an inner threaded section for locking with the threaded interface connector of the electronic device, the nut further having a receptacle for receiving the outer flange of the inner sleeve therein; and a conductive grounding spring mounted in the annular groove of the inner sleeve, the conductive grounding spring having multiple inner resilient concave sections for tightly mechanically and electrically connecting with a circumference of the threaded interface connector of the electronic device.

2. The grounding electrical connector as claimed in claim 1, wherein the conductive grounding spring further has a front and a rear annular end sections, the multiple inner resilient concave sections being integrally interconnected between the front and rear annular end sections.

3. The grounding electrical connector as claimed in claim 1, wherein the conductive grounding spring further has an annular main body, the multiple inner resilient concave sections being integrally connected with an end of the annular main body, the multiple inner resilient concave sections extending from the end of the annular main body and being bent into the annular main body.

* * * * *